US005236097A

United States Patent [19]

Behm et al.

[11] Patent Number: 5,236,097

[45] Date of Patent: Aug. 17, 1993

[54] PLASTIC CONTAINER WITH IMPROVED BASE STRUCTURE

[75] Inventors: Dale H. Behm, Ann Arbor, Mich.; Randall S. Brown, Streetsboro, Ohio

[73] Assignee: Hoover Universal Inc., Plymouth, Mich.

[21] Appl. No.: 787,617

[22] Filed: Nov. 4, 1991

[51] Int. Cl.[5] ..... B65D 1/02; B65D 23/00

[52] U.S. Cl. ..... 215/1 C; 220/606

[58] Field of Search ..... 215/1 C; 220/604, 606

[56] References Cited

U.S. PATENT DOCUMENTS

| | | | |
|---|---|---|---|
| 3,884,383 | 5/1975 | Burch et al. | 220/606 X |
| 4,037,752 | 7/1977 | Dulmaine et al. | 220/606 |
| 4,344,627 | 6/1982 | Krishnakumar et al. | 220/606 X |
| 4,598,831 | 7/1986 | Nakamura et al. | 215/1 C |
| 4,785,948 | 11/1988 | Strassheimer | 220/606 X |
| 4,885,197 | 12/1989 | Strassheimer | 215/1 C X |
| 4,892,205 | 1/1990 | Powers et al. | 220/606 X |
| 5,005,716 | 4/1991 | Eberle | 220/606 X |
| 5,047,271 | 9/1991 | Feddersen et al. | 215/1 C X |

FOREIGN PATENT DOCUMENTS

| | | | |
|---|---|---|---|
| 62-28335 | 2/1987 | Japan | 220/604 |
| 2146137 | 6/1987 | Japan | 215/1 C |
| 2235041 | 10/1987 | Japan | 215/1 C |
| 1-99949 | 4/1989 | Japan | 215/1 C |
| 2067160 | 7/1981 | United Kingdom | 215/1 C |

*Primary Examiner*—Sue A. Weaver

*Attorney, Agent, or Firm*—Harness, Dickey & Pierce

[57] ABSTRACT

A plastic container having an improved base structure. The base structure generally includes an inwardly domed inner wall having panels formed therein. The panels are inclined relative to the remainder of the inner wall and, at the juncture, form inwardly directed corners that provide increased stiffness and structural integrity to the base structure allowing use of the container with low carbonation beverages. The panels are also integrally formed with a lower end of an outer wall which defines a line of contact extending continuous around the base structure. This simplified base structure makes the container more cost efficient to produce and also allows it to be used with non-carbonated beverages.

16 Claims, 1 Drawing Sheet

PLASTIC CONTAINER WITH IMPROVED BASE STRUCTURE

BACKGROUND AND SUMMARY OF THE INVENTION

The present invention generally relates to plastic containers for beverages and, more particularly, to a blow molded plastic container having an improved base structure for use with non-carbonated and low carbonation beverages.

Prior to the development of integral base structures, blow molded containers were produced with a rounded or outwardly convex bottom over which was glued a separate base cap. The base cap had a contact ring for stabilizing and supporting the container. These base cap containers were unsatisfactory since, being of a two piece construction, they were costly.

With the wide acceptance of plastic beverage containers, and in an effort to reduce cost, containers having integral self-supporting base structures were developed. These plastic containers generally incorporated a bottom, forming an outer support ring having an upwardly extending and downwardly concave recessed center, often referred to as a "champagne bottom".

During the production cycle of a blow molded plastic container, a preform is axially stretched and inflated to impart both axial and radial elongation to the material. In the art, this forming is known as biaxial orientation or elongation. Early integral base structures were vulnerable to stress cracking and crystallinity problems as a result of over stretching and poor temperature control during molding. Specifically, the center region of the base structure received little stretch and was formed of amorphous non-oriented material, while the outer edges of the base were overstretched and thin. Both resulting regions were weak.

In the current production of plastic containers, the weakest part of the container continues to be the base structure. For example, when a container formed with a champagne bottom is filled with a carbonated beverage, the tendency of the champagne bottom is to invert to a downwardly convex shape. Various configurations have been developed to provide reinforcement to the bottom structure in an attempt to prevent this inversion.

To overcome these limitations, containers have been provided with reinforced base structures including ribs or webs of increased thickness. Unfortunately, these reinforced structures increased the amount of raw material needed to produce the final product an correspondingly increased the final cost of the container.

One container with a self-supporting and reinforced base is disclosed in U.S. Pat. No. 4,334,627. In this patent, a container is disclosed as having a base structure with a plurality of internally formed and radially extending reinforcement ribs. In addition to the increased raw material requirements, the initial formation of the ribbed preform is time consuming and further adds to the overall cost of the container.

Another container with a self-supporting base is disclosed in U.S. Pat. No. 4,892,205. This patent discloses forming a container having circumferentially spaced hollow feet which exhibit structural integrity sufficient to resist roll out. The feet have a flat bottom surface of a generally trapezoidal shape which decreases in width along a radially inward direction. The footed base structure has a contact surface which extends less than 360° base structure. Because of this, the upright stability of the container may be compromised when placed on a rack or grid shelf of the type often found in a household refrigerator.

While containers of the above-mentioned type work satisfactorily with highly carbonated beverages, e.g. beverages such as soft drinks, when used with non-carbonated or low carbonation beverages, the reinforcement structures of these containers provide strength greater than that required and the intricate molding requirements are more complex than necessary resulting in an more costly container. Low carbonation, as used in the present invention, generally refers to carbonated beverages having internal container pressures of about forty-five pounds per square inch (45 psi) and less.

As can be seen from the above discussion, there is a need for a container having a base structure strong enough to resist roll out, when used for packaging low carbonation beverages, yet which may be cost effectively produced so as to permit its use with non-carbonated beverages. The present invention is directed to fill this need.

With the above in mind, it is an object of this invention to provide a container which can be used with both non-carbonated and low carbonation beverages. In achieving this, the container is inexpensive to produce and has a base configuration whose simplicity lends itself to processability.

An additional object of the invention is to provide the container with a base structure that exhibits increased stability on grid type support surfaces.

In satisfying the above objects, the present invention provides for a blow molded plastic container which may be readily produced from a preform without the structural requirement of internal ribs. Because of its simplicity, the base structure of the present invention allows for a container to be constructed without precision technology in either the processing of the plastic, the forming of the preform or the actual blow molding of the final container.

Accordingly, a plastic container embodying the principles of the present invention includes a base structure having a continuous bearing surface for contacting a support surface. The continuous bearing surface provides increased stability to the container when stored or positioned upright on a grid or rack type shelf. The bearing surface is formed by the radius where the outer wall merges with the inner wall of the base structure. The radius of the bearing surface is kept as small and as "sharp" as possible. Roll out, when the container is used with low carbonated beverages, is prevented by providing the dome shaped, downwardly concave inner wall of the base structure with a plurality of panels.

The panels are positioned adjacently around the outermost portion of the inner wall. Each panel is inclined relative to the dome of the inner wall so as to form corners, at the juncture therewith, directed interiorly of the container. The corners and the panels cooperate to stiffen the inner wall and enable the base structure to maintain its structural integrity when the container is filled with a beverage. Adjacent to the bearing surface, the lower edge portions of the panels themselves are substantially straight. The upper edge portions of the panels are generally arcuate at the juncture with the inner wall and, thus, the corners are also arcuate. The bearing surface is part of a support wall that connects the inner wall to a convex outer wall. The outer wall merges the base structure with the side wall of the container.

As the dome is forced downward by the internal pressure of the container or the weight of the contents, the lower edges of the panels interact with the radius of the bearing surface and the corners. In trying to invert the corners, the interaction creates a "pinch-point" at the radius of the bearing surface which further increases stiffness and resistance to roll out.

It is important that the panels be planar or if not perfectly planar, convex or bowed toward the outer wall so that downward forces on the inner wall tend to pinch the panels toward the outer wall and thereby preclude roll out of the inner wall.

Additional advantages of the invention will be apparent to those skilled in the art from the following description of the preferred embodiments and the appended claims.

DETAILED DESCRIPTION OF THE PREFERRED EMBODIMENT

Figure 1:
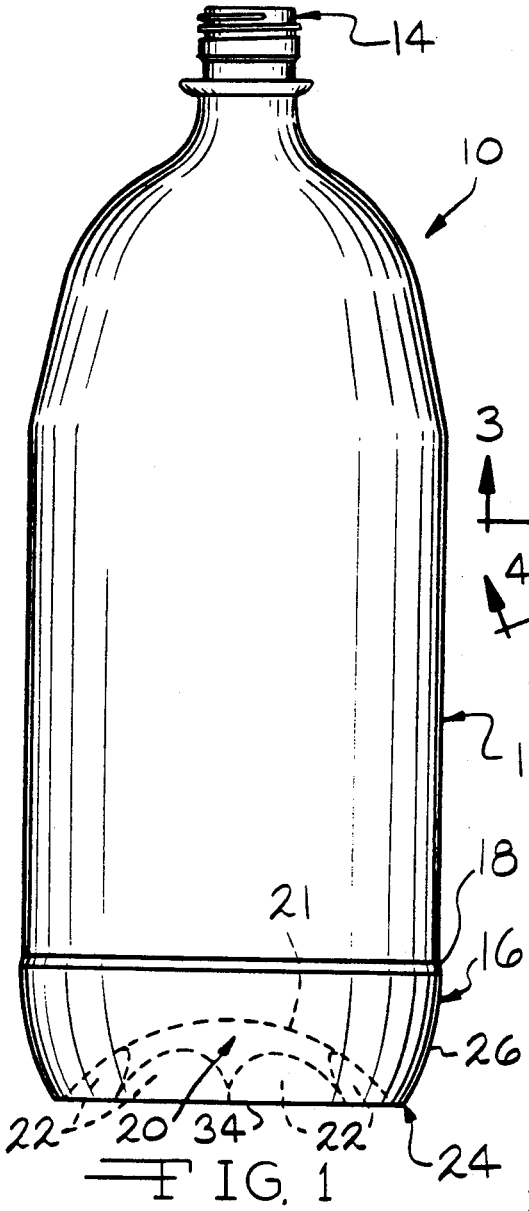
FIG. 1 is a side elevational view of a container embodying the principles of the present invention.

Now with reference to the drawing, a blow molded container embodying the principles of the present invention is generally illustrated in FIG. 1 and designated by reference number 10. The container 10 is preferably blow molded from polyethylene terepthalate (PET) and generally includes a cylindrical side wall 12 having an integral closure mouth 14 formed at the upper end of the side wall 12 and an integral base structure 16 formed at the lower end of the side wall 12. The closure mouth 14 is adapted to receive a closure cap (not shown) and is a rigid ring which restrains the mechanical loads imposed by such closures. In the illustrated embodiment, the closure mouth 14 is threaded to receive a threaded cap. However, non-threaded closure methods may be used. A flash line or scar 18 generally designates where the upper end of the base structure 16 merges with the lower end of the side wall 12.

The base structure 16 of the present invention may be generally described as having three integral portions. These portions include an inner wall 20, a support wall 24 and an outer wall 26. As further described below, the inner wall 20 includes a dome portion 21 (hereinafter dome 21) and a number of panels 22.

The outer wall 26 is generally annular in shape and has a substantially convex exterior surface. As such, from the scar 18, where the outer wall 26 merges with the side wall 12, the outer wall 26 extends downward and inward so as to surround the inner wall 20.

The inner wall 20 projects interiorly of the container 10 and has a general dome shape, terminating at a central apex 28. As seen in the figures, the exterior surface of the inner wall 20 is generally concave.

Figure 2:
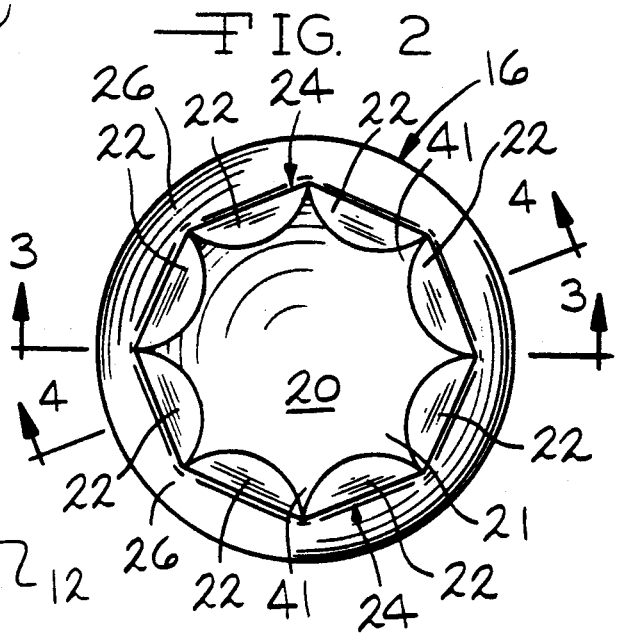
FIG. 2 is a bottom view of the base structure of the container shown in FIG. 1.
Figure 3:
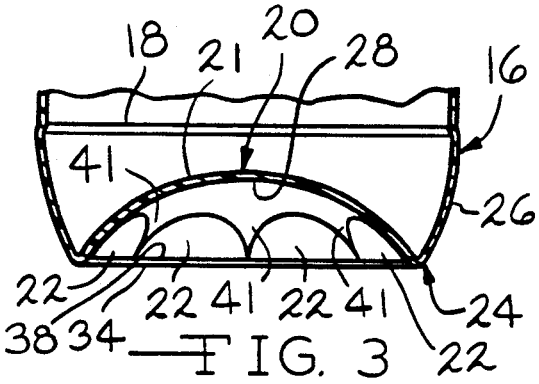
FIG. 3 is a cross sectional view of the base structure taken substantially along line 3—3 of FIG. 2.
Figure 4:
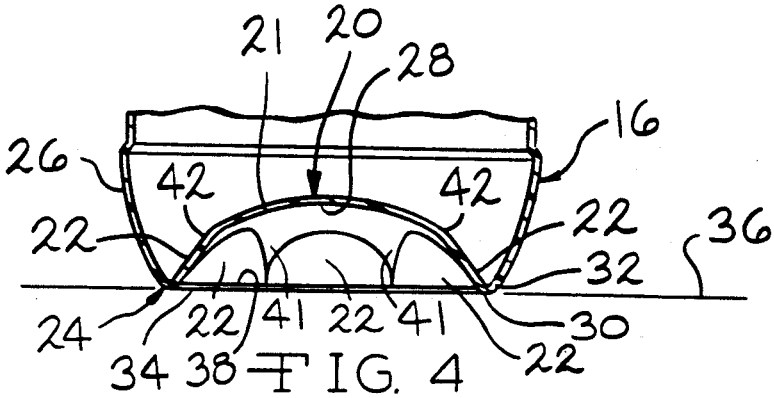
FIG. 4 is a cross sectional view of the base structure taken substantially along line 4—4 of FIG. 2.

The support wall 24 connects the inner wall 20 with the outer wall 26 and includes an inboard side and an outboard side, respectfully designated at 30 and 32, exhibiting a radius of curvature therebetween. The radius of curvature of the support wall 24 further defines a bearing surface 34 around the base structure 16. The bearing surface 34 contacts a supporting surface (generally designated at 36) and provides stability to the container 10 when in its upright position Forming a 360° ring, the bearing surface 34 extends continuously and completely around the base structure 16 increasing the support and stability of the container 10 and allowing the container 10 to be placed on a wire rack or grid-type shelf, as often found in a household refrigerator, without any appreciable loss in stability. As seen in FIGS. 2–4, since the inner wall 20 is joined with the outer wall 26 through the radius of curvature of the support wall 24, the bearing surface 34 forms a continuous line of support around the base structure 1.

Integrally formed in the inner wall 20 are the dome 21 and the panels 22 mentioned above. The dome 21 is formed primarily in the center of the inner wall 20 and the panels 22 are formed around the circumference of the outer edge region of the inner wall 20 in side by side relation to one another.

Each panel 22 is substantially planar and includes a generally defined straight lower edge 38, where the panel 22 is connected to the inboard side 30 of the support wall 24, and a generally defined arcuate upper edge 40 where the panel 22 intersects with the dome 21 of the inner wall 20. As such, each panel 22 is semi-circular in shape. In the space between the arcuate edges 40 of each adjacent panel 22, is an extension or continuation of the dome 21 which is hereinafter referred to as a land section or a finger 41. As seen in FIG. 3, these land sections 41 are continuations or extensions of the dome and have a concave exterior surface. While the preferred panels 22 are described herein as being generally planar, it is anticipated that an outwardly convex panel, exhibiting the above mentioned lower and upper edges 38 and 40, could also be employed.

The panels 22 and the dome 21 are angularly inclined relative to one another and their juncture, along the arcuate upper edge 40, forms a corner 42 that is directed toward the interior of the container 10. This corner 42 is best seen in FIG. 4 where it is viewed in vertical section.

When the container 10 is filled with a beverage having a level of carbonation, the pressure attempts to invert the corners 42. The interaction of the corners 42 with the panels 22 and the interaction of the panels 22 with the inboard side 30 of the support wall 24 creates a "pinch-point" at the juncture of the panels 22 and the support wall 24 which increases the stiffness of the inner wall 20 thereby enabling the inner wall 20 to maintain its structural integrity and prevent roll out.

The embodiment of the container 10 illustrated in the drawing includes eight panels 22 of uniform size being equidistantly positioned around the outer edge region of the inner wall 20. In this fashion, the uniform lengths of the straight lower edges 38 generally cooperate with the support wall 24 to provide the bearing surface 34 with the octagonal configuration illustrated in FIG. 2. While eight panels 22 are shown, it is contemplated that three to twelve panels 22 will provide sufficient structural integrity to the container 10, it being preferred that the panels 22 range in number from six to eight.

In blow molding of the container 10 of the present invention, neither the PET preform nor the final product requires the provision of internal ribs. B eliminating the ribs and other reinforcement structures, the process for forming the preform is simplified and the amount of PET material used for forming the final container 10 is reduced. During molding, the PET preform will readily conform to the domed and planar shapes defining the base structure 16. The complexity of blowing the PET preform into small openings or voids is eliminated. By reducing the amount of PET used and by simplifying the process and mechanical complexities involved with production of the container 10, the container 10 of this invention can be produced with sufficient cost efficiently to permit use with non-carbonated beverages while maintaining its structural integrity to permit use with low carbonation beverages.

While the above description constitutes the preferred embodiment of the present invention, it will be appreciated that the invention is susceptible to modification, variation and change without departing from the proper scope and fair meaning of the accompanying claims.

What is claimed is:

1. A plastic container comprising:

a hollow body including a generally cylindrical side wall having upper and lower ends and a mouth structure merging with said upper end of said side wall;

a base structure merging with said side wall at said lower end thereof and including an outer wall and an inner wall connected by a support wall defining a continuous bearing surface around said base structure;

said inner wall being generally dome shaped and extending interiorly of said hollow body, said inner wall having a center region and a radially positioned outer edge region;

said outer wall being generally annular in shape and surrounding said support wall and said inner wall, said outer wall having an upper end portion merging with said side wall and a lower end portion extending downwardly and inwardly toward said support wall; and a plurality of panels being formed in said outer edge region in side by side relation around said inner wall, said panels forming intermediate wall sections connecting said center region with said support wall, said panels being relatively inclined with respect to said center region of said inner wall when viewed in vertical section so as to form corners at a juncture therewith, said corners being directed interiorly of said container and cooperating with said panels to stiffen said inner wall enabling said inner wall to maintain its structural integrity when said container is filled, said panels and said lower end of said outer wall being generally upright and relatively inclined so that the outer wall applies a force to the lower end of said panels which maintains said panels in stiffening positions when said body is subjected to the forces of a liquid in the body.

2. A plastic container as set forth in claim 1 wherein said inner wall includes land sections extending between adjacent panels.

3. A plastic container as set forth in claim 2 wherein said land sections are continuations of said center region and having generally concave exterior surfaces.

4. A plastic container as set forth in claim 1 wherein said panels are substantially planar.

5. A plastic container as set forth in claim 1 wherein said continuous bearing surface is formed by a plurality of segments located around said base structure.

6. A plastic container as set forth in claim 1 wherein said continuous bearing surface is generally octagonal in shape.

7. A plastic container as set forth in claim 1 wherein said panels include portions defining an inner edge and an outer edge, said inner edge having an arcuate shape and being formed at said juncture of said panels with said center region of said inner wall.

8. A plastic container as set forth in claim 7 wherein said outer edges of said panels are substantially straight and adjacent said continuous bearing surface of said support wall.

9. A plastic container as set forth in claim 1 wherein said base structure includes eight of said panels.

10. A plastic container as set forth in claim 1 wherein said panels are semi-circular in shape.

11. A blow molded plastic container comprising:

a hollow body including a generally cylindrical side wall having upper and lower ends, a mouth structure merging with said upper end of said side wall;

a base structure merging with said side wall at said lower end thereof, said base structure including an inner wall and an outer wall connected by a support wall, said support wall defining a continuous bearing surface extending around said base structure;

said inner wall being generally dome shaped and extending interiorly of said hollow body, said inner wall having a center region and a radially positioned outer edge region, said center region having a generally concave exterior surface and including a plurality of radially extending land sections;

said outer wall being generally annular in shape and surrounding said support wall and said inner wall, said outer wall having a convex exterior surface and including an upper end merging with said side wall and a lower end extending downwardly and inwardly therefrom; and a plurality of generally planar panels being adjacently formed in said outer edge region in side by side relation around said inner wall, said panels forming intermediate wall sections connecting said center region of said inner wall with said support wall, said panels being relatively inclined with respect to said center region when viewed in vertical section so as to form corners at a juncture therewith, said corners being directed interiorly of said container and cooperating with said panels so that said panels apply a force to said support wall which maintains said panels in stiffening positions thereby stiffening said inner wall and enabling said inner wall to maintain its structural integrity when said container is filled with a liquid.

12. A plastic container as set forth in claim 11 wherein said panels includes portions defining an inner edge and an outer edge, said inner edge having an arcuate shape and being adjacent said juncture of said panels with said center region of said inner wall.

13. A plastic container as set forth in claim 12 wherein said outer edges of said panels are substantially straight and adjacent said juncture of said panels and said support wall.

14. A plastic container as set forth in claim 11 wherein said panels are substantially semi-circular in shape

15. A plastic container as set forth in claim 11 wherein said base structure includes at least three of said panels.

16. A plastic container as set forth in claim 11 wherein said base structure includes eight panels.

* * * * *